United States Patent [19]

Peterson et al.

[11] Patent Number: 4,549,948

[45] Date of Patent: Oct. 29, 1985

[54] SACRIFICIAL ANODE COMPOSITION

[75] Inventors: Marvin L. Peterson, Ponca City, Okla.; Charles F. Putnik, Katy, Tex.; Orwin G. Maxson, Ponca City, Okla.

[73] Assignee: Conoco Inc., Ponca City, Okla.

[21] Appl. No.: 271,490

[22] Filed: Jun. 8, 1981

Related U.S. Application Data

[60] Division of Ser. No. 180,235, Aug. 22, 1980, Pat. No. 4,318,787, which is a continuation-in-part of Ser. No. 123,863, Feb. 22, 1980, abandoned.

[51] Int. Cl.[4] ..... C23F 13/00

[52] U.S. Cl. ..... 204/196; 204/291; 204/292; 252/308

[58] Field of Search ..... 204/148, 197; 252/312, 252/308

[56] References Cited

U.S. PATENT DOCUMENTS

| | | | |
|---|---|---|---|
| 3,085,985 | 4/1963 | Koch et al. | 260/17 |
| 3,565,817 | 2/1971 | Lissant | 252/312 |
| 3,617,095 | 11/1971 | Lissant | 252/312 |
| 3,936,170 | 2/1976 | Shibano et al. | 252/512 |
| 3,968,056 | 7/1976 | Bolon et al. | 252/512 |
| 4,089,767 | 5/1978 | Sabins | 204/197 |
| 4,201,637 | 5/1980 | Peterson et al. | 204/197 |

*Primary Examiner*—T. Tung

*Attorney, Agent, or Firm*—Stephen A. Littlefield

[57] ABSTRACT

A composition which is particularly suitable for providing cathodic protection of metal structures is disclosed. The composition comprises a major amount of particulate anode material and a minor amount of a thixotropic carrier material. A method of using the composition is disclosed. Also, an apparatus which uses the composition is disclosed.

5 Claims, 2 Drawing Figures

SACRIFICIAL ANODE COMPOSITION

CROSS-REFERENCE TO RELATED APPLICATIONS

This is a division of application Ser. No. 180,235, filed Aug. 22, 1980, now U.S. Pat. No. 4,318,787, issued Mar. 9, 1982, which was a continuation-in-part of application Ser. No. 123,863, filed Feb. 22, 1980, and now abandoned.

BACKGROUND

1. Field of the Invention

The invention is in the field of providing cathodic protection of metal structures, especially steel offshore platforms, by the use of sacrificial anodes.

2. General Background

Sacrificial anodes and/or impressed current anodes are used on most offshore steel structures to prevent or reduce seawater corrosion of the steel. Generally these anode systems must be installed during platform fabrication. Replacement while the structure is located in the sea is difficult and expensive because divers must be used and work in deep water must be limited because of the high cost and danger to the workmen. In an effort to provide adequate protection, many very sacrificial anodes are required to protect a structure for a typical lifetime of 20–40 years. The additional weight and wave forces on the anodes can become quite significant.

U.S. Pat. No. 4,201,637, issued May 6, 1980, and based on an application filed Nov. 15, 1978, discloses an apparatus and method wherein the sacrificial anodes can be replenished periodically or continuously. Briefly, the method comprises feeding the anode in particulate form to a container located under the surface of the water and electrically connected to the structure to be protected.

Our invention provides another improvement in the means of providing anode material continuously to the structure to be protected.

Also, our invention provides an improvement over the apparatus and method disclosed in U.S. Pat. No. 4,201,637. This feature will be described in detail later in our disclosure.

BRIEF SUMMARY OF THE INVENTION

Briefly stated, the present invention is directed to a composition, particularly suitable for providing cathodic protection of metal structures, said composition comprising a major amount of particulate anode material and a minor amount of thixotropic carrier material.

In one embodiment the invention is directed to an improvement in the method of providing cathodic protection of metal structures, subjected to a corrosive water environment, by means of sacrificial anodes located in a perforated subsurface container attached to said structure, said sacrificial anode being supplied through a tubing to the subsurface container, the improvement comprising supplying the sacrificial anode as a composition where the anode material is in particulate form suspended in a thixotropic carrier material.

In still another embodiment the invention is directed to an improved cathodic protection apparatus for use on a steel offshore structure, said apparatus comprising:

(a) a perforated subsurface container containing a composition which comprises a major amount of anode material in particulate form and a minor amont of a thixotropic carrier material, (b) a source of supply for said composition, (c) a conduit running from said source of supply to said subsurface container, and (d) means for feeding the composition to the container in response to the electrochemical potential requirement of the structure being protected, said apparatus being characterized further in that it is electrically connected to the offshore structure.

DESCRIPTION OF THE ILLUSTRATIVE EMBODIMENTS

Figure 1:
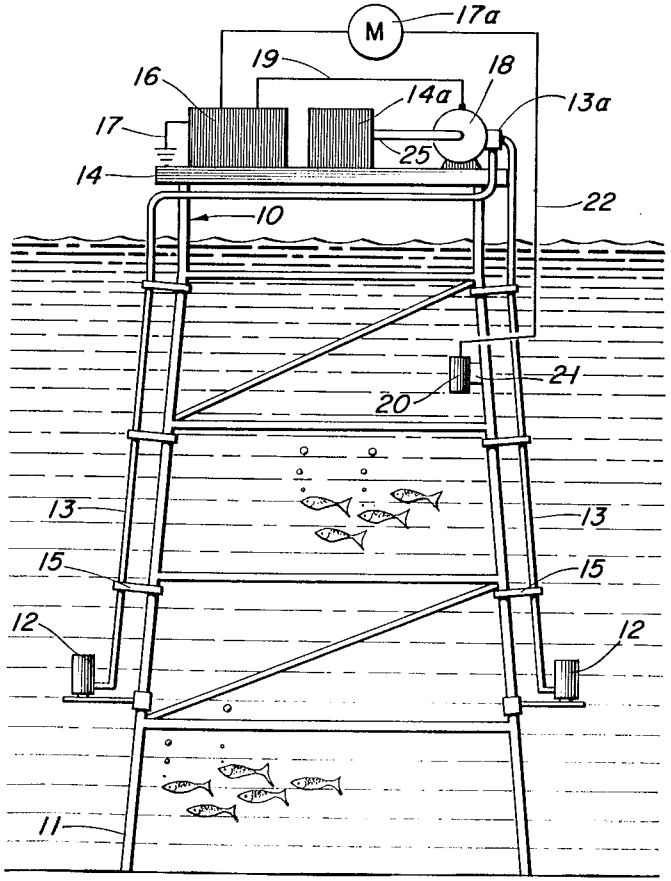
FIG. 1 is a view in side elevation of an installation incorporating the invention.

As shown in FIG. 1 an offshore platform 10 is supported by support members 11 which are partially immersed in sea water. A container 12, for the thixotropic composition, is located in the sea water, with a conduit (or tubing) 13 extending to a pump 18 located on the deck section 14, located above water surface, of the platform 10. The tubing 13 and container 12 are attached to a support member 11 by means of clamps, rods or welded brackets 15. The tubing 13 makes a right-angle turn prior to joining the container 12. When the apparatus uses two or more subsurface containers 12 a manifold **13*a*, or similar device, is present between the pump 18 and the tubing 13. While shown on the deck section 14 it is readily apparent that the manifold 13*a*** can be located below the surface of the water.

A container **14*a*, for the thixotropic composition is located on the deck secton 14. The container is connected by means of a conduit 25 to a pump 18, also located on the deck section 14. A control box 16 on the deck section 14 is electrically attached to the platform at connection 17. This connection serves as a "ground", i.e. to complete the electrical circuit. A potential measuring device 17*a* is placed between the control box 16 and a reference electrode 20. Electrical connection between the control box 16 and the reference electrode 20 is provided by an electrical conductor 22. The potential measuring device measures the electrochemical requirement of the structure. The control box in response to this measurement through electrical conductor 19 actuates the pump 18 and forces the thixotropic composition through the conduit 13 to the container 12**.

Figure 2:
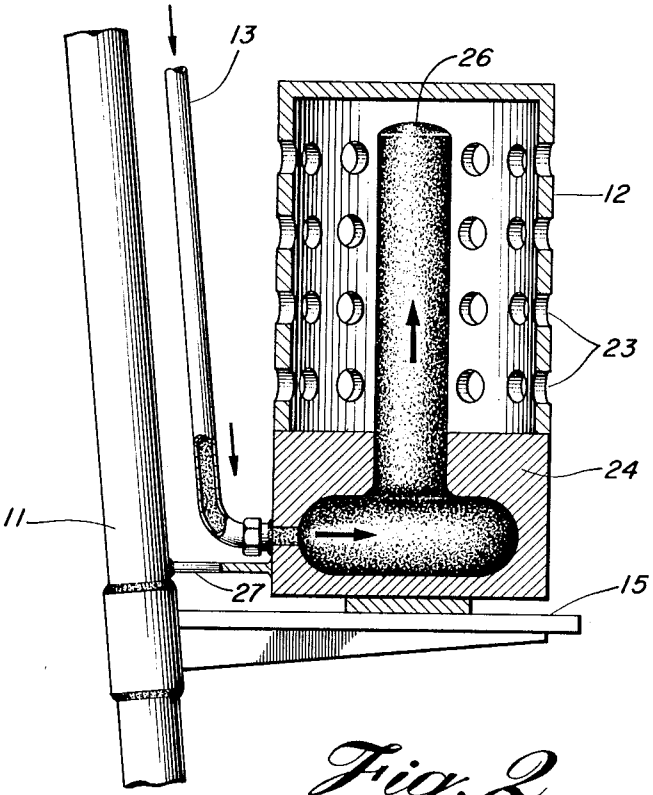
FIG. 2 is a cross-sectional view of a portion of the apparatus of FIG. 1.

FIG. 2 is a cross-sectional view of the container 12 and related structures. The container has perforations 23 to allow the water to enter it. It is attached to the support member 11 by a support bracket 15. The lower portion of the container is an extrusion die 24 made of steel. A separate electrical connection 27 is provided if necessary to provide electrical connection between the underwater apparatus and the offshore platform. Typically as the thixotropic composition is extruded from the die it is in elongated shape 26.

DETAILED DESCRIPTION

The composition of our invention comprises a major amount of particulate anode material and a minor amount of thixotropic carrier material.

Suitable thixotropic carrier materials for use in my invention meet the following requirements: slight solubility in sea water and a viscosity which renders it pumpable at ambient temperature in the sea water. More specifically the thixotropic carrier material should have the following properties:

(a) solubility in sea water of about 0.1 to about 5.0 weight percent, preferably about 1.0 to about 3.0 weight percent; and (b) a viscosity of less than 2,000,000 cp., preferably, less than 1,500,000 cp. at a temperature as low as 4° C.

Examples of materials which are suitable as the thixotropic carrier materials include ethoxylated alcohols, ethoxylated mono- or dialkyl phenols and sulfated alcohol ethoxylates.

Suitable ethoxylated alcohols are represented by the formula $$RO(CH_2CH_2O)_nH$$

wherein R is an alkyl group containing from 10 to 20, preferably 14 to 20, carbon atoms and n is a number in the range of 1 to 5, preferably 1.5 to 4.

Suitable ethoxylated mono- or dialkyl phenols are those wherein each alkyl group contains from about 8 to about 12 carbon atoms, and contain about 2.0 to about 10.0 ethoxy groups, preferably from about 3.0 to about 7.0 ethoxy groups. A preferred ethoxylated alkyl phenol is monononylphenol containing about 3.0 to about 7.0 ethoxy groups.

Suitable sulfated alcohol ethoxylates are represented by the structural formula $$[CH_3(CH_2)_xCH_2(OCH_2CH_2)_nOSO_3]M$$

wherein x is an integer in the range of about 8 to about 20, preferably from about 10 to about 16, n is a number in the range of about 0 to about 5.0, preferably about 0.5 to about 4.0, more preferably about 1.5 to about 3.5, and M is Na, K, or $NH_4$, but preferably is sodium.

The alcohol moiety of the ethoxylated alcohol sulfate can have an even number or odd number of carbon atoms or be a mixture thereof. Preferably, the alcohol moiety has an even number of carbon atoms. Also, preferably, the alcohol moiety contains 12 to 18 carbon atoms.

Sacrificial anodes are well-known in the art. Accordingly, the type of material used to prepare sacrificial anodes is well-known in the art. The material used for the anodes should have a higher anodic solution potential in the environment that does the metal of the structure being protected.

Since ordinarily offshore petroleum drilling and production platforms are constructed of structural steel the metal anode is made of materials such as zinc, aluminum, magnesium or alloys of these materials. While any of these materials may be used in our invention the preferred anode material is aluminum. Of course, it is recognized that minor amounts of other elements can be present in the anode material.

It is necessary that the anode material be present as small particles. The shape of the particles is not important. Suitably the anode material should have a maximum dimension of less than 12 mm. preferably less than 6 mm.

The composition of our invention contains from about 60 to about 90 weight percent anode material, preferably from about 70 to about 85 weight percent.

Important features of the anode-containing composition are slight solubility in sea water and high concentration of the anode material. These features enable the composition to be electrically conductive in the environment used.

The preparation of the composition is relatively straight forward. The required amount of anode material is added to the carrier material and the resulting admixture is agitated until homogeneous.

The subsurface container for the anode-containing composition should contain perforations in order to allow the water access to the sacrificial anodes. The size of the subsurface container is not critical. It can be fabricated of steel, metal, suitable plastics or fiberglass. A preferred material for preparing the container is an epoxy-fiberglass composite molding.

The container can be supported by a number of suitable means, such as clamps or rods attached to the platform.

As stated hereinbefore a tubing is used to convey the anode-containing composition from the container on the deck to the subsurface container. The tubing can be made of metal or plastic. One advantage of our invention is that small diameter tubing can be used. Steel is a particularly suitable material for the tubing.

A multiplicity of conduits and subsurface containers can be provided on the steel platform in order to protect the entire structure. The number of these can be readily determined by those skilled in the art. Also, the means of locating them on the platform can be readily determined.

If necessary, a separate electrical connection is provided between the underwater apparatus and the offshore platform. In other words, if the tubing, subsurface container and support members are made of non-conductors a separate electrical connection must be provided.

As is implied throughout, our apparatus does not have an impressed current. The voltage and current are provided by the potential difference of the metal in the platform and the sacrificial anode metal.

Our apparatus uses a control means, located above surface, for feeding the anode-containing composition to the container in response to the electrochemical demand of the anode. Optimally, the amount of material fed to the container is the same as the amount consumed. The control means is attached to the platform and is electrically connected to the anode wire by suitable means. This control means can work in several ways. Reference electrodes can be used. The voltage can be measured. These measurements can be used to automatically control the pump which feeds the anode-containing composition to the container.

A typical control apparatus comprises the following. A voltmeter with a low limit switch which drives a solenoid switch. The solenoid switch controls an electric motor which drives the feed pump for the anode composition. The pump can push the anode composition through the conduit. The control apparatus has a timer cut-off switch in the circuit.

The preferred composition of our invention comprises the following: the carrier material is an alcohol ethoxylate wherein the alkyl group is linear and contains 14 to 16 carbon atoms. The average level of ethoxylation is 1.7 moles. The composition contains 80 weight percent of aluminum having a maximum particle size of 6 mm.

Our preferred apparatus comprises the following:

(a) perforated subsurface container made of steel, (b) tubing for feeding the anode material to the container, said tubing being made of steel, (c) an electrical conductor made of steel between the anode material and the metal structure being protected, (d) a control means for feeding the anode-containing composition to the subsurface container in response to the electrochemical demand, said control means comprising a volt-meter with a low limit switch driving a solenoid switch which drives an electric motor driving the pump with a timer cut-off switch for the system.

The following example illustrates the invention using the preferred apparatus and the preferred anode-containing composition.

An offshore platform which is located in the Gulf of Mexico has a jacket weight of 3,200 tons. In order to protect the structure an average of 6 tons of anode material is required per year. This amounts to 1.69 pounds per hour of the composition. An apparatus is used which has 12 protective devices as described herein located about the structure. The required amount of composition is pumped through the manifold and tubing to the subsurface containers.

ADVANTAGES OF OUR INVENTION

As compared to the method and apparatus of U.S. Pat. No. 4,201,637, our invention has at least the following advantages:

(1) The anodes of the patent are fed to the subsurface container by gravity. By contrast, the composition containing the anode material of our invention is pumped under pressure to the subsurface container. Because of this turns are allowed in our apparatus. The composition can even be pumped toward the surface of the water.

(2) Since the tubing of the patent is open to the water foreign materials can get in the tube. It is conceivable that barnacles could exist inside the tubing. In our invention the tubing is completely filled with the anode-containing composition. Thus, this problem cannot occur.

(3) Use of the composition which has small particles of anode materials permits the use of smaller size tubing, which provides several advantages. These advantages include lower weight, less drag, and easier handling. In addition the tubing can contain valves.

Thus, having described the invention in detail, it will be understood by those skilled in the art that certain variations and modifications may be made without departing from the spirit and scope of the invention as defined herein and in the appended claims.

We claim:

1. An extrudable composition, particularly suitable for providing cathodic protection of metal structures, said composition consisting essentially of from about 60 to about 90 weight percent of particles of zinc, aluminum, magnesium or alloys thereof, said particles having a maximum dimension of less than 6 mm, and from about 10 to about 40 weight percent of a thixotropic carrier material, said thixotropic carrier material having a solubility in sea water of about 0.1 to about 5.0 weight percent and a viscosity of less than 2,000,000 cp. at 4° C., said thixotropic carrier material being selected from the group consisting of ethoxylated alcohols, ethoxylated mono- or dialkyl phenols and sulfated alcohol ethoxylates.

2. The composition of claim 1 wherein it contains particles of aluminum.

3. The composition of claim 2 wherein the ethoxylated alcohols are represented by the formula $$RO(CH_2CH_2O)_nH$$

wherein R is an alkyl group containing from 10 to 20 carbon atoms and n is a number in the range of 1 to 5.

4. The composition of claim 2 wherein the ethoxylated mono- or dialkyl phenols have alkyl groups containing from about 8 to about 12 carbon atoms and contain about 2.0 to about 10.0 ethoxy groups.

5. The composition of claim 2 wherein the sulfated alcohol ethoxylates are represented by the formula $$[CH_3(CH_2)_xCH_2(OCH_2CH_2)_nOSO_3]M$$

wherein x is an integer in the range of about 8 to about 20, n is a number in the range of about 1 to about 5.0, and M is Na, K, or $NH_4$.

* * * * *